United States Patent [19]

Hughes

[11] Patent Number: 4,536,167

[45] Date of Patent: Aug. 20, 1985

[54] ROCKING MECHANISM

[75] Inventor: David C. Hughes, South Hadley, Mass.

[73] Assignee: Milton Bradley Company, Springfield, Mass.

[21] Appl. No.: 560,893

[22] Filed: Dec. 14, 1983

[51] Int. Cl.[3] ..... A63H 11/02

[52] U.S. Cl. ..... 446/396; 74/87; 74/113; 446/325; 446/358; 446/484

[58] Field of Search ..... 74/61, 87, 113; 446/322, 325, 358, 484, 396

[56] References Cited

U.S. PATENT DOCUMENTS

| | | | |
|---|---|---|---|
| 2,252,290 | 8/1941 | Konikoff | 446/396 X |
| 2,611,214 | 9/1952 | Schur | 446/325 |
| 3,298,120 | 1/1967 | Walden | 446/322 X |
| 3,837,113 | 9/1974 | Triska | 446/325 |
| 4,308,758 | 1/1982 | Humphrey | 74/61 X |

FOREIGN PATENT DOCUMENTS

| | | | |
|---|---|---|---|
| 410223 | 5/1934 | United Kingdom | 446/325 |

*Primary Examiner*—Martin P. Schwadron
*Assistant Examiner*—Stephen M. Hepperle
*Attorney, Agent, or Firm*—Ross, Ross & Flavin

[57] ABSTRACT

A rocking mechanism for providing an interesting, apparently random motion for a toy or game using an electric motor with very low battery drain, wherein an unbalancing weight is mounted on a driven wheel driven by a small PM motor, the wheel carrying a cam which controls the action of a first switch connecting the motor to a battery with a second horizontal sensing switch connected in parallel with the first switch, all mounted in a frame which allows it to rock three-dimensionally. In a modified form of rocking mechanism for providing apparently random motion using a spring-loaded motor, an unbalancing weight is mounted on a driven wheel driven by a spring motor linked by a gear train to an oscillating escapement and pin actuator for controlling the unwinding of the motor spring, all mounted in a frame which allows it to rock three-dimensionally.

6 Claims, 3 Drawing Figures

ROCKING MECHANISM

My invention relates to a rocking mechanism for providing an interesting, apparently random motion for a toy or a game using an electric motor with very low battery drain.

A primary object of the invention is to provide a rocking mechanism using a battery-operated motor wherein, although motion never ceases, the motor is operating for only short periods of time, typically 5 to 10 percent; which means that battery life is extended by 10–20 times.

The mechanism utilizes an unbalancing weight which is mounted on a driven wheel driven by a small PM motor. Also mounted on the wheel is a cam which controls the action of a first switch connecting the motor to a battery. A horizontal sensing switch is connected in parallel with the first switch. All of the above is mounted in some frame which allows it to rock three-dimensionally on such as a spherical surface or a pivot.

Figure 1:
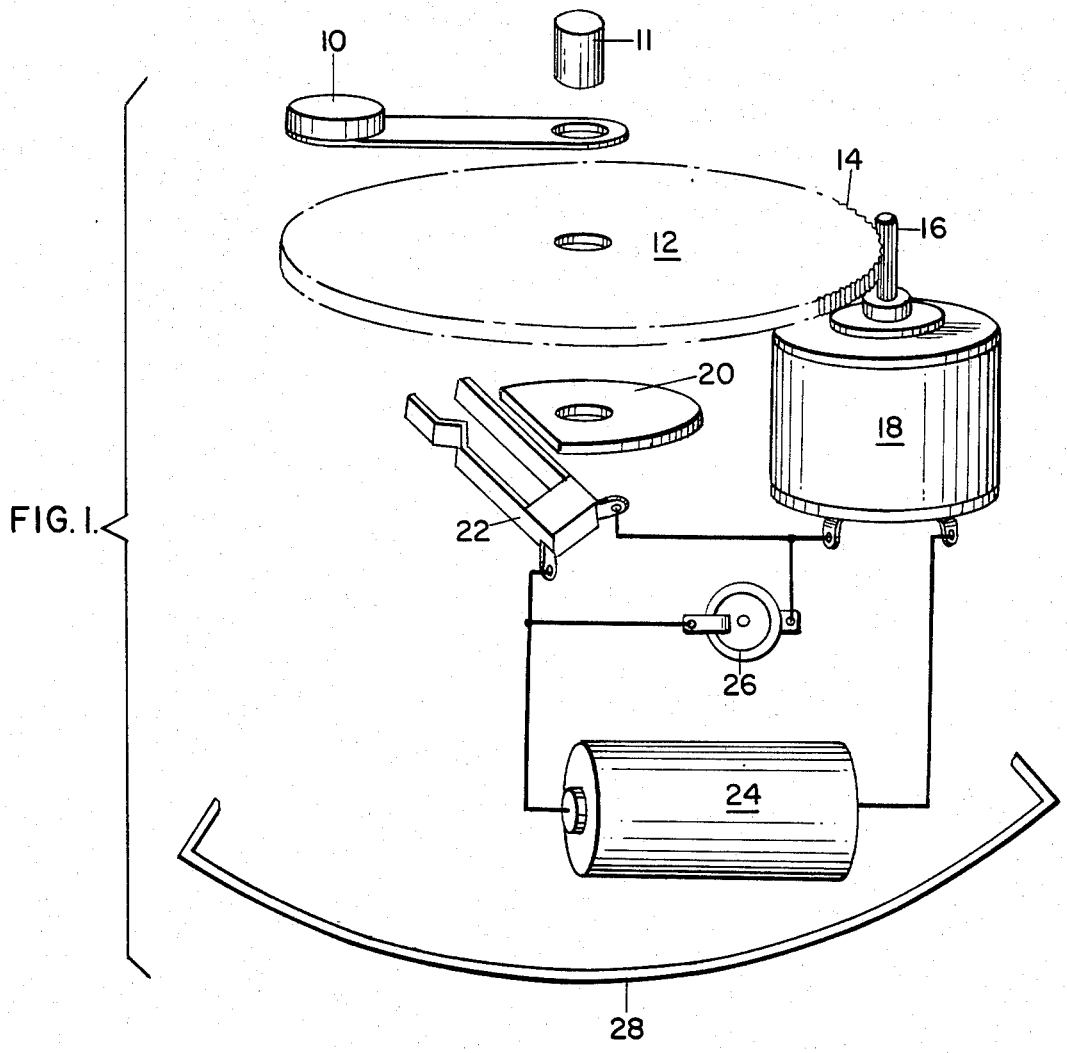
FIG. 1 is an exploded somewhat schematic perspective view of one form of rocking mechanism embodying the invention.

The essential components embodying a preferred form of the rocking mechanism are shown in FIG. 1 and include an unbalancing weight 10 which is mounted as by a pin 11 on a driven wheel 12 having a frictional rim 14 so that it can be driven by the shaft 16 of a small PM motor 18. Also mounted on pin 11 and the wheel 12 is a cam 20 which controls the action of a first switch 22 connecting the motor 18 to a battery 24. A second switch 26 of the horizontal sensing type is connected in parallel with first switch 22. All of the above is mounted in a frame which allows it to rock three-dimensionally here illustrated as a spherical surface 28, but which may also be a pivot.

The operation of the rocking mechanism is as follows:

The relation of the cam 20 to the weight 10 is such that the whole system is in balance when the first switch 22 is open. However, when the system is balanced it will tend to bring the second switch 26 to a horizontal position at which time it will close. This energizes the motor 18 which rotates the wheel 12 with its weight 10 and unbalances the system causing it to rock from the horizontal. This opens second switch 26 (horizontal sensing) but closes first switch 22 due to the action of the cam 20 and so the motor will continue to drive until the weight has returned to its balanced position and first switch 22 is opened by the cam. Due to the inertia of the total system the rocking motion will continue for some time depending on friction, distribution of weight, restoring force, etc. While rocking continues, second switch 26 will not come to the horizontal and close, or it may pass through the horizontal briefly advancing the cam a small amount but not enough to close first switch 22.

When the cam 20 has advanced far enough to close first switch 22, the cycle repeats itself.

The effect of this delay is that although motion never ceases the motor 18 is operating for only short periods of time, typically 5 to 10 percent; which means that battery life is extended by 10–20 times.

The second horizontal sensing switch 26 can be a ball-in-cage switch, a mercury switch or a short, actuating pin projecting from the exact bottom of the spherical surface 28 on which the system rocks. All three have been built and demonstrated.

Figure 2:
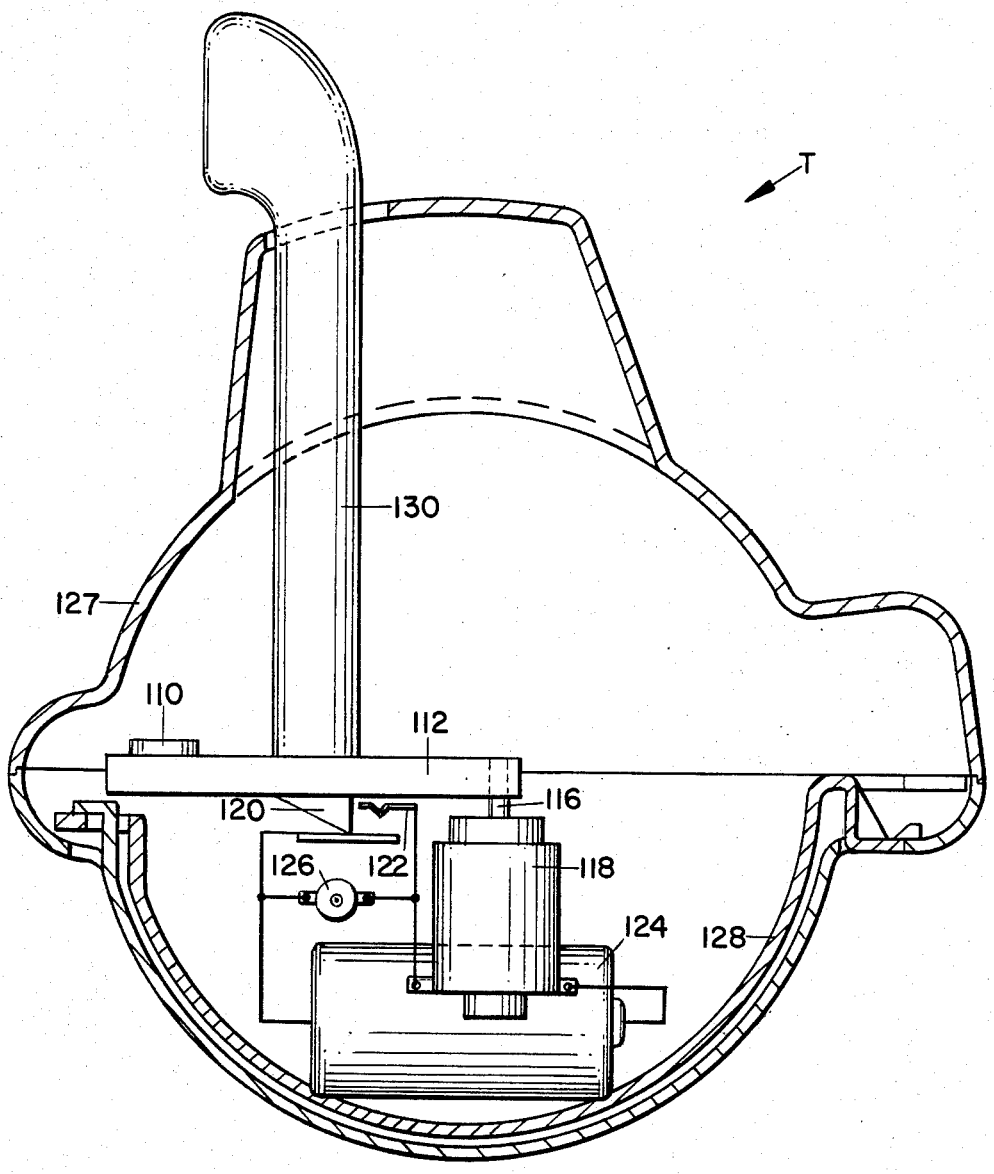
FIG. 2 is a cross-sectional showing of a modified form of the invention embodied in a rocking toy.

The invention is illustrated in FIG. 2 as embodied in a spherical rocking toy submarine T which includes an unbalancing weight 110 mounted on a driven wheel 112 driven by the pin 116 of a small PM motor 118. Also mounted on the wheel 112 is a cam 120 which controls the action of a first switch 122 connected to the motor 118 and a battery 124. A horizontal sensing switch 126 is connected in parallel with the first switch and to the battery. All of the above is mounted in a frame 127 which allows it to rock three-dimensionally here illustrated as a spherical surface 128.

Additional action can be had by loosely coupling an external member, such as a submarine periscope 130, to the wheel 112, so that the periscope will revolve as the wheel turns.

This embodiment operates in the same manner as described with reference to FIG. 1.

Figure 3:
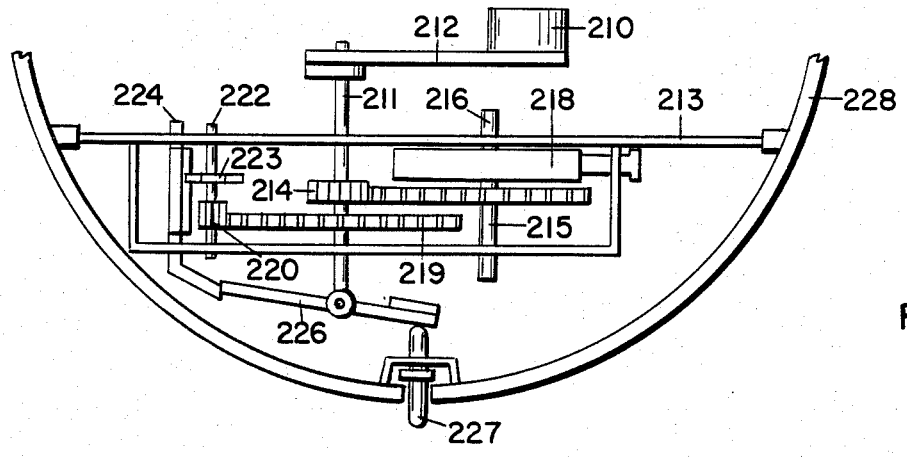
FIG. 3 is a cross-sectional showing of another modified form of rocking mechanism embodying the invention.

The intermittent motion principle is illustrated in FIG. 3 as applicable to a wind-up motor using a projecting pin actuator to control the unwinding of the motor spring. This system greatly extends the action time of the wind-up.

In the FIG. 3 embodiment, an unbalancing weight 210 is mounted on a driven wheel 212 having a shaft 211 depending therefrom and journalled in a frame 213.

Shaft 211 carries a small gear 214 thereon. Gear 214 meshes with a large gear 215 carried by the shaft 216 of a spring motor 218, shaft 216 also being journalled in frame 213.

Shaft 211 carries a large gear 219 which meshes with a small gear 220 carried by a second shaft 222 disposed in spaced parallelism to first shaft 211 and journalled in frame 213.

A star gear 223 mounted on shaft 222 engages an oscillating escapement 234 which, in turn, engages one end of a linkage stop 226 pivoted to the lower end of shaft 211.

The opposite end of linkage stop 226 engages a pin actuator 227 slidably mounted in the lower segment of a spherical surface 228 of frame 213.

In operation, when the linkage stop 226 is in the position as shown in FIG. 3, it interferes with the oscillating escapement 224 and prevents the spring motor 218 from unwinding.

At this time the unbalancing weight 210, which is mounted on the same shaft 211 as the linkage stop 226, is in the balanced position.

The distribution of weight within the spherical surface 228 is such that the arrangement will come to rest eventually on the pin actuator 227, forcing it up.

The pin actuator 227 will push up on the linkage stop 226 causing it to move out of the way of the oscillating escapement 224 and allowing the spring motor 218 to unwind.

The unbalancing weight 210 (and the linkage stop 226), will make one revolution and come to rest as before where the linkage stop interferes with the oscillating escapement 224.

The revolution of the unbalancing weight 210 has set the arrangement rocking and this will continue until the motion subsides enough for the actuating pin 227 to be again pressed.

I claim:

1. A rocking mechanism comprising: an unbalancing weight mounted on a driven wheel driven by a motor, control means for effecting intermittent rotation of the wheel by the motor, all mounted in a frame which allows it to rock three-dimensionally, the relation of the control means to the weight and motor being such that when the whole system is in balance the motor is energized by said control means to rotate the wheel together with its weight to unbalance the system causing it to rock from the horizontal, with the motor continuing to drive the wheel until the weight has returned to its balanced position at which time, due to the inertia of the total system, the rocking motion will continue for some time depending on friction, distribution of weight and restoring force.

2. A rocking mechanism according to claim 1, wherein the motor is a small battery PM electric motor, and said control means comprises a cam carried by said wheel which controls the action of a first switch connecting the motor to the battery, with a second horizontal sensing switch connected in parallel with the first switch.

3. A rocking mechanism according to claim 1 wherein the motor is of the spring-loaded windup type, and the unwinding of the motor spring is controlled by a pin actuator projecting from the frame.

4. A rocking mechanism according to claim 1, wherein the frame is a toy submarine and including a periscope loosely coupled to the wheel and revolvable as the wheel is rotated.

5. A rocking mechanism comprising: an unbalancing weight mounted on a driven wheel driven by a motor, a cam mounted on the wheel for controlling the action of a first switch connecting the motor to a battery, a second horizontal sensing switch connected in parallel with the first switch, all mounted in a frame which allows it to rock three-dimensionally, the relation of the cam to the weight being such that the whole system is in balance when the first switch is open thus bringing the horizontal sensing switch to a horizontal position at which time it will close to energize the motor which rotates the wheel together with its weight, which both unbalances the system causing it to rock from the horizontal to open the second horizontal sensing switch and also closes the first switch due to the action of the cam wherefore the motor will continue to drive until the weight has returned to its balanced position and the first switch is opened by the cam, at which time, due to the inertia of the total system, the rocking motion will continue for some time depending on friction, distribution of weight and restoring force.

6. A rocking mechanism comprising: an unbalancing weight mounted on a driven wheel driven by a spring motor, a linkage stop operatively connected to the wheel for controlling the action of an oscillating escapement operatively connected to the motor, and an actuating pin selectively engageable by the linkage stop, all mounted in a frame which allows it to rock three-dimensionally, whereby when the linkage stop is in a first position it interferes with the oscillating escapement and prevents the spring motor from unwinding, at which time the unbalancing weight is in a balanced position, with the distribution of weight within the frame being such that the pin actuation comes into contact with the linkage stop, forcing the linkage stop to move out of interference with the oscillating escapement and allowing the spring motor to unwind, whereupon the unbalancing weight and the linkage stop will make one revolution and come to rest as before wherein the linkage stop interferes with the oscillating escapement, with the revolution of the unbalancing weight setting the arrangement rocking, with rocking continuing until the motion subsides enough for the actuating pin to be again moved.

* * * * *